United States Patent [19]

Ichida et al.

[11] Patent Number: 4,739,735

[45] Date of Patent: Apr. 26, 1988

[54] INTERNAL COMBUSTION ENGINE

[75] Inventors: Katsumi Ichida, Tokyo; Toshinari Sonoda, Saitama; Hiroshi Abe, Tokyo, all of Japan

[73] Assignee: Honda Giken Kogyo Kabushiki Kaisha, Tokyo, Japan

[21] Appl. No.: 820,421

[22] Filed: Jan. 17, 1986

[30] Foreign Application Priority Data

Jan. 18, 1985 [JP] Japan ..... 60-7079
Jan. 18, 1985 [JP] Japan ..... 60-7080

[51] Int. Cl.[4] ..... F01L 1/26

[52] U.S. Cl. ..... 123/90.23; 123/90.27; 123/52 MV; 123/193 H

[58] Field of Search ..... 123/52 MV, 193 H, 90.27, 123/90.23, 90.44

[56] References Cited

U.S. PATENT DOCUMENTS

| | | | |
|---|---|---|---|
| 2,927,564 | 3/1960 | Turlay et al. | 123/52 MV |
| 2,963,009 | 12/1960 | Dolza | 123/52 MV |
| 3,738,338 | 6/1973 | Wickman | 123/90.27 |
| 4,527,518 | 7/1985 | Osaki et al. | 123/90.23 |
| 4,621,597 | 11/1986 | Kawada et al. | 123/90.27 |

*Primary Examiner*—Craig R. Feinberg
*Assistant Examiner*—M. Macy
*Attorney, Agent, or Firm*—Lyon & Lyon

[57] ABSTRACT

An internal combustion engine includes a cylinder head having attachment surfaces which lie in the same plane and to which a head cover and an intake manifold are attached, respectively. The attachment surfaces can therefore be machined simultaneously in one process with a common cutting tool. The internal combustion engine also has a valve operating mechanism housed in a valve mechanism chamber in the cylinder head for actuating intake and exhaust valves. The valve mechanism chamber is defined by a pair of opposite trapezoidal end walls extending from the bottom of the valve mechanism chamber and a ceiling wall integrally interconnecting the upper ends of the trapezoidal end walls. The valve mechanism chamber has a pair of windows defined one on each side of the ceiling wall thereof between the trapezoidal end walls to provide access therethrough to the valve operating mechanism. The cylinder head has a plurality of cylindrical plug housings extending between the ceiling walls of the combustion chambers and the ceiling wall of the valve mechanism chamber for accommodating the spark plugs. The spark plugs are substantially aligned with the axes of the cylinders in the cylinder block. Head covers can easily be attached to and detached from the cylinder head separate from the plug housings.

8 Claims, 5 Drawing Sheets

INTERNAL COMBUSTION ENGINE

The present invention relates to an internal combustion engine and more particularly to the construction of an overhead valve type cylinder head.

Conventional internal combustion engines with overhead valves include a cylinder head normally having a head cover attachment surface lying parallel to the joining surface or interface along which the cylinder head is joined to the cylinder block. The cylinder head also has an intake manifold attachment surface slanted at an angle with respect to the head cover attachment surface and the joining interface. Thus, when the cylinder head is manufactured, the head cover attachment surface and the intake manifold attachment surface must individually be machined at a high degree of machining accuracy.

It would be highly advantageous if the head cover attachment surface and the intake manifold attachment surface were in the same plane so that they could simultaneously be machined by one cutting tool whereby these attachment surfaces would be machined highly accurately in one process. In U.S. Pat. No. 2,856,909 an engine is disclosed with cylinder heads having the head cover attachment surface and intake manifold attachment surface in the same plane but valve operating mechanism and valves are all on one side of the cylinders.

In more modern overhead cam and valve type engines the valves are on both sides of the combustion chamber and the cylinder head is fully open at its upper end to provide a window to the valve mechanism chamber defined in the cylinder head, the window being closed by a head cover attached to the upper surface of the cylinder head. It is desirable to position the spark plug in the center of the ceiling of the combustion chamber and plug housings in which the spark plugs are accommodated extend between the head cover and the ceiling walls of combustion chambers in the cylinder head. Sealing members are interposed between the plug housings and the head cover. The spark plugs thus arranged can ignite the air-fuel mixture substantially centrally in the respective combustion chambers for a higher engine power output and better fuel economy. When the head cover is to be detached from the cylinder head for inspecting and servicing the valve operating mechanism in the valve mechanism chamber, the head cover must also be separated from the plug housings. Therefore, at the time of attaching the head cover again to the cylinder head, it is necessary to mount the sealing members properly between the head cover and the plug housings. Such a mounting process is however tedious and time-consuming. If the seal membersare mounted improperly or damaged, lubricating oil in the valve mechanism chamber will leak into the plug housing.

It is an object of the present invention to provide an internal combustion engine having a cylinder head which can be machined highly accurately and efficiently.

Another object of the present invention is to provide an internal combustion engine cylinder head including spark plugs positioned in substantial alignment with the axes of cylinders and a head cover attachable to and detachable from the cylinder head separate from the plug housings in which the spark plugs are accommodated, so that both good engine performance and good serviceability of a valve operating mechanism can be ensured.

According to the present invention, an internal combustion engine includes a cylinder head having attachment surfaces which lie in the same plane for the head cover and the intake manifold whereby the attachment surfaces can be machined simultaneously in one process with a common cutting tool.

The internal combustion engine cylinder head of this invention has a valve operating mechanism housed in a valve mechanism chamber for actuating intake and exhaust valves, the valve mechanism chamber being defined by a pair of opposite trapezoidal end walls extending from the bottom of the valve mechanism chamber and a ceiling wall integrally interconnecting the upper ends of the trapezoidal end walls. The valve mechanism chamber has a pair of windows defined one on each side of the ceiling wall thereof between the trapezoidal end walls to provide access therethrough to the valve operating mechanism. The cylinder head has cover attachment surfaces extending peripherally around the windows, respectively, and a plurality of cylindrical plug housings extending between the ceiling walls of the combustion chambers and the ceiling wall of the valve mechanism chamber for accommodating the spark plugs substantially in alignment with the axes of cylinders in a cylinder block on which the cylinder head is mounted. Thus, the head covers can easily be attached to and detached from the cover attachment surfaces irrespective of the plug housings.

The above and other objects, features and advantages of the present invention will become more apparent from the following description when taken in conjunction with the accompanying drawings in which a preferred embodiment of the present invention is shown by way of illustrative example.

FIG. 1 shows a V-type multicylinder internal combustion engine including two cylinder arrays C1, C2 arranged in a V shape as viewed in front elevation. The cylinder arrays C1, C2 define a central space or valley V therebetween in which there is disposed a common intake manifold Mi communicating with intake ports 8 of the cylinder arrays C1, C2.

Figure 1:
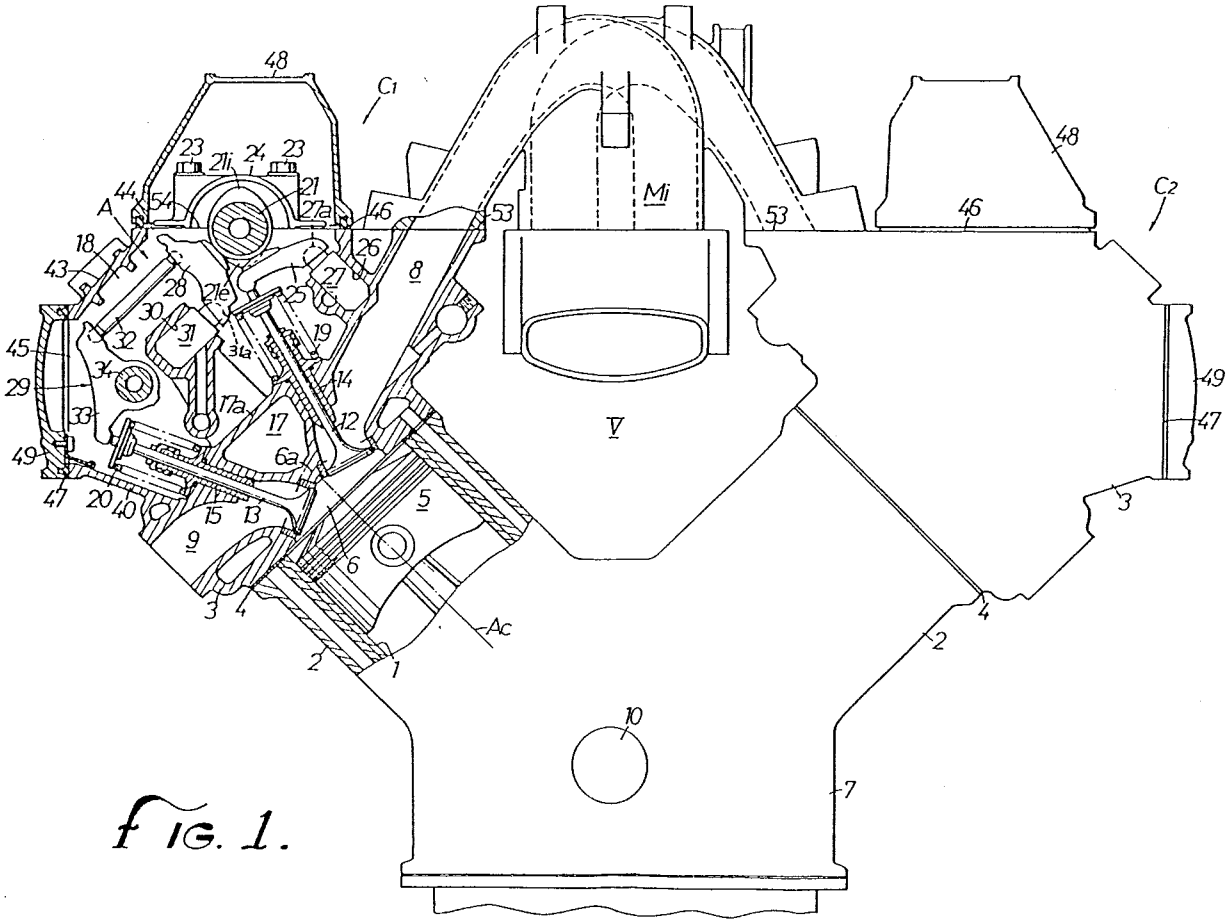
FIG. 1 is a front elevation view, partly in cross section, of a V-type multicylinder internal combustion engine according to the present invention.

Since the cylinder arrays C1, C2 are symmetrical in construction, only the cylinder array C1 positioned on the lefthand side in FIG. 1 will be described in detail below.

The cylinder array C1 has a cylinder block 2 defining cylinders 1 therein and a cylinder head 3 secured to the upper surface of the cylinder block 2 with a gasket 4 interposed therebetween. A piston 5 is slidably fitted in each of the cylinders 1. The cylinder head 3 has a combustion chamber 6 defined between in its bottom surface and the top of the piston 5.

The cylinder blocks 2 of the cylinder arrays C1, C2 are integrally formed with a common crankcase 7 shared by the cylinder arrays C1, C2. A common crankshaft 10 is rotatably supported in the crankcase 7 and operatively coupled to the pistons 5 in the cylinder arrays C1, C2 in a conventional manner.

Figure 3:
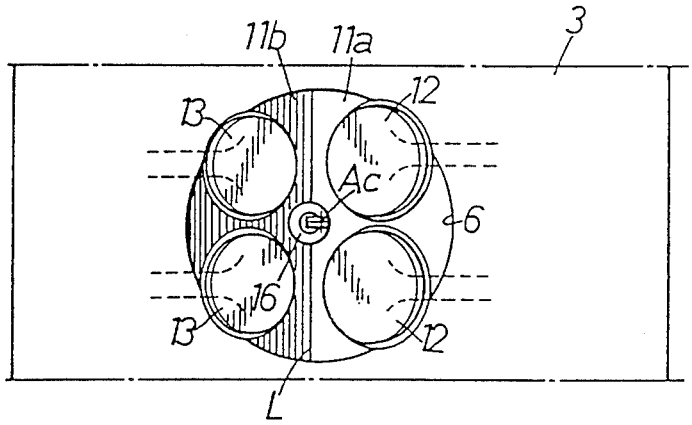
FIG. 3 is a fragmentary bottom view of one combustion chamber ceiling of the cylinder head of the internal combustion engine.

As shown in FIGS. 1 and 3, each combustion chamber 6 has a ceiling wall surface on the cylinder head comprising two slanted surfaces 11*a*, 11*b* inclined progressively downwardly away from each other from a diametrical central line L extending approximately across the axis Ac of the cylinder 1 parallel to crankshaft 10. The center lines L of all of the combustion chambers 6 in the respective cylinder arrays C1, C2 are on a common line. Each of the intake ports 8 has a pair of inlet holes opening in the slanted surface 11*a* closer to the valley V, and each of the exhaust ports 9 has a pair of outlet holes opening in the opposite slanted surface 11*b*, each pair of inlet and outlet holes being arranged parallel to the line L. A pair of intake valves 12 and another pair of exhaust valves 13 for opening and closing the intake and exhaust ports 8, 9 are slidably supported in valve guide sleeves 14, 15, respectively, which are mounted in the cylinder head 3.

Figure 2:
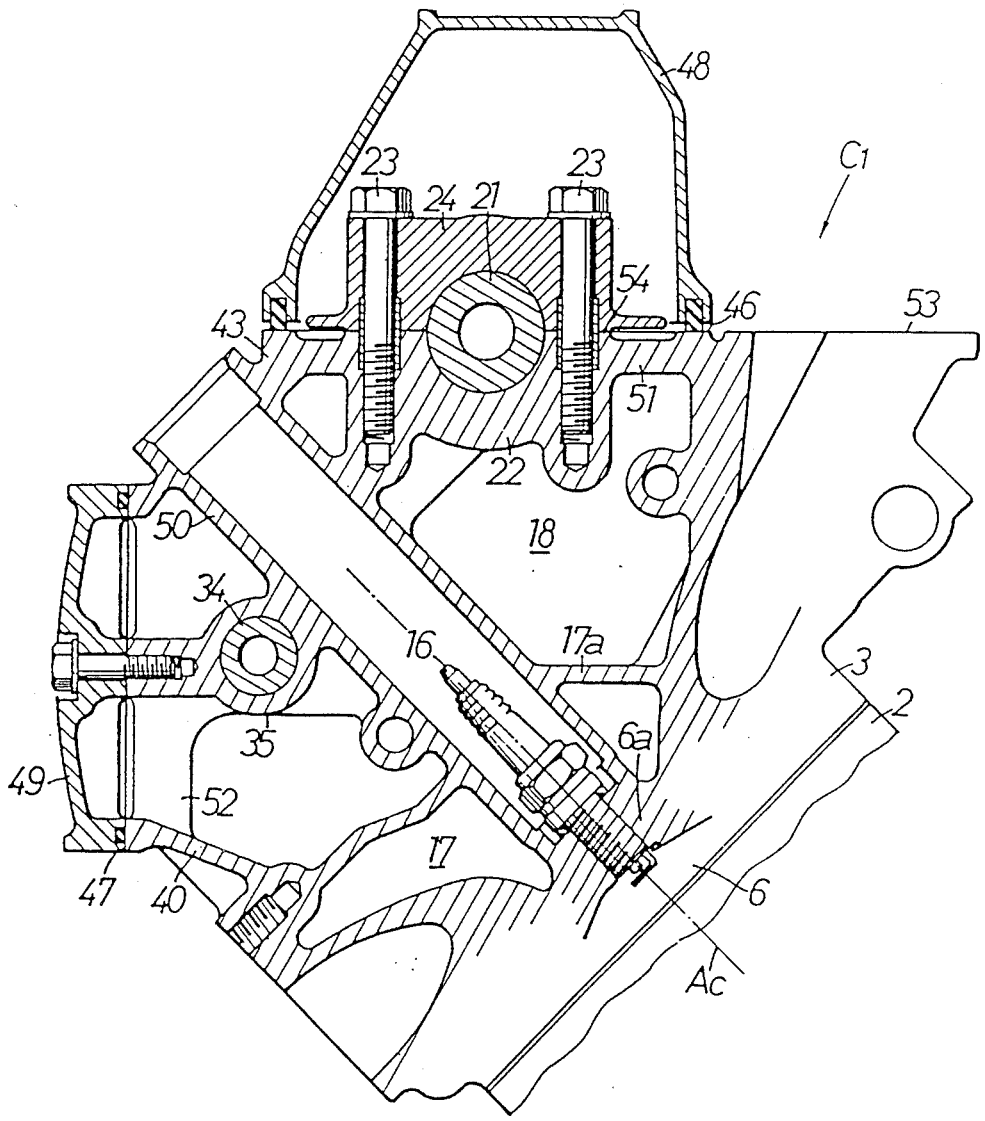
FIG. 2 is an enlarged cross-sectional view of the cylinder head portion of the internal combustion engine shown in FIG. 1.

As illustrated in FIG. 2, spark plugs 16 (only one shown) are threadedly mounted in a ceiling wall 6*a* of the combustion chamber 6 with the spark plug electrodes positioned in the combustion chamber 6. The spark plug 16 is substantially aligned with the axis Ac of the cylinder 1 and surrounded by the four intake and exhaust valves 12, 13 (see FIG. 3). By this arrangement an extremely efficient intake an ignition of the air-fuel mixture and exhaust of the burned mixture is accomplished.

As shown in FIGS. 1 and 2, the cylinder head 3 defines therein a water jacket 17 above the combustion chambers 6 and a valve mechanism chamber 18 above the water jacket 17. The valve mechanism chamber 18 accommodates therein a valve operating mechanism A for actuating the intake and exhaust valves 12, 13 to open and close the intake and exhaust ports 8, 9.

As shown in FIG. 1, valve springs 19, 20 are disposed around the valve stems of the intake and exhaust valves 12, 13, respectively, and act thereon for normally urging them to close the intake and exhaust ports 8, 9. A single cam shaft 21 is disposed substantially directly above the intake valves 12, i.e., in a position deviated from the cylinder axis Ac toward the valley V. The cam shaft 21 extends parallel to the crankshaft 10 and is operable thereby through a synchronous transmission mechanism (not shown). As illustrated in FIG. 2, the cam shaft 21 is rotatably supported between a series of longitudinally spaced bearing bases 22 (only one shown) integral with the cylinder head 3 and bearing caps 24 (only one shown) fastened by bolts 23 to the bearing base 22.

By positioning the cam shafts 21 in the cylinder arrays C1, C2 closer to the valley V, the maximum outer dimensions of the cylinder arrays C1, C2 are minimized to reduce the overall size of the V-type engine.

As shown in FIG. 1, the cam shaft 21 has intake and exhaust cams 21*i*, 21*e* operatively associated with the intake and exhaust valves 12, 13, respectively. First cam followers 25 are interposed between the intake cams 21*i* and the heads or upper ends of the valve stems of the intake valves 12 and have sides held in sliding engagement with the intake cams 21*i*. Each of the first cam followers 25 has an end pivotally supported on the hemispherical end 27*a* of a first hydraulic tappet 27 mounted in a supporting hole 26 defined in the cylinder head 3.

A second cam follower 28 has an intermediate portion with a side thereof held in sliding engagement with each exhaust cam 21*e*. Each second cam follower 28 has an upper end operatively coupled through an interlink mechanism 29 to the exhaust valve 13 and a lower end pivotally supported on the hemispherical end 31*a* of a second hydraulic tappet 31 mounted in a supporting hole 30 defined in the cylinder head 3.

Each of the interlink mechanisms 29 comprises a pusher rod 32 having one end engaging the second cam follower 38 at a point spaced from the cam shaft 21, and a bellcrank-shaped rocker arm 33 having one end engaging the opposite end of the pusher rod 32 and the other end engaging the head or upper end of the valve stem of the exhaust valve 13. The rocker arm 33 is pivotally supported on a rocker shaft 34 that is supported on bearing bosses 35 integral with the cylinder head 3.

During operation of the engine, the cam shaft 21 in each of the cylinder arrays C1, C2 is rotated by the crankshaft 10 through the non-illustrated synchronous transmission mechanism. When each piston 5 starts its intake stroke, the raised portions of the intake cams 21*i* push the first cam followers 25 toward the intake valves 12, causing the followers 25 to pivot about the hemispherical ends 27*a* of the first hydraulic tappets 27. The intake valves 12 open the intake port 8 against the resilient forces of the valve springs 19 for thereby introducing an air-fuel mixture into the combustion chamber 6 through the intake manifold Mi and the intake port 8. The intake valves 12 close approximately at the end of the intake stroke of piston 5 which then starts the compression stroke toward the cylinder head 3.

When the compressed air-fuel mixture in the combustion chamber 6 is ignited by a spark produced by the spark plug 16 as the piston 5 is about to reach the end of its compression stroke, the air-fuel mixture is combusted and the piston 5 begins an expansion or power stroke. Inasmuch as the spark plug 16 is positioned in alignment with or close to the axis Ac of the cylinder 1, the flame propagation distances from the igniting point to the peripheral edge of the combustion chamber 6 are substantially equal to allow the entire air-fuel mixture to be burned in a short period of time. Therefore, the power output of the engine is increased and its fuel economy is improved.

Following the power stroke, as the piston 5 initiates an exhaust stroke the raised portions of the exhaust cams 21*e* push the second cam followers 28 about the hemispherical ends 31*a* of the second hydraulic tappets 31 for thereby pushing the pusher rods 32 to turn the rocker arms 33 toward the exhaust valves 13. The exhaust valves 13 are moved against the resiliency of the valve springs 20 to open the exhaust port 9 for discharging the exhaust gas from the combustion chamber 6 into the exhaust port 9.

When the intake and exhaust valves 12, 13 are closed, the first and second hyraulic tappets 27, 31 are extended in the known manner to cause the hemispherical ends 27*a*, 31*a* to push the ends of the cam followers 25, 28 for eliminating any gap which would otherwise be produced between cam followers 25, 28 and the heads of the stem of valve 12 and rod 32, respectively.

Figure 4:
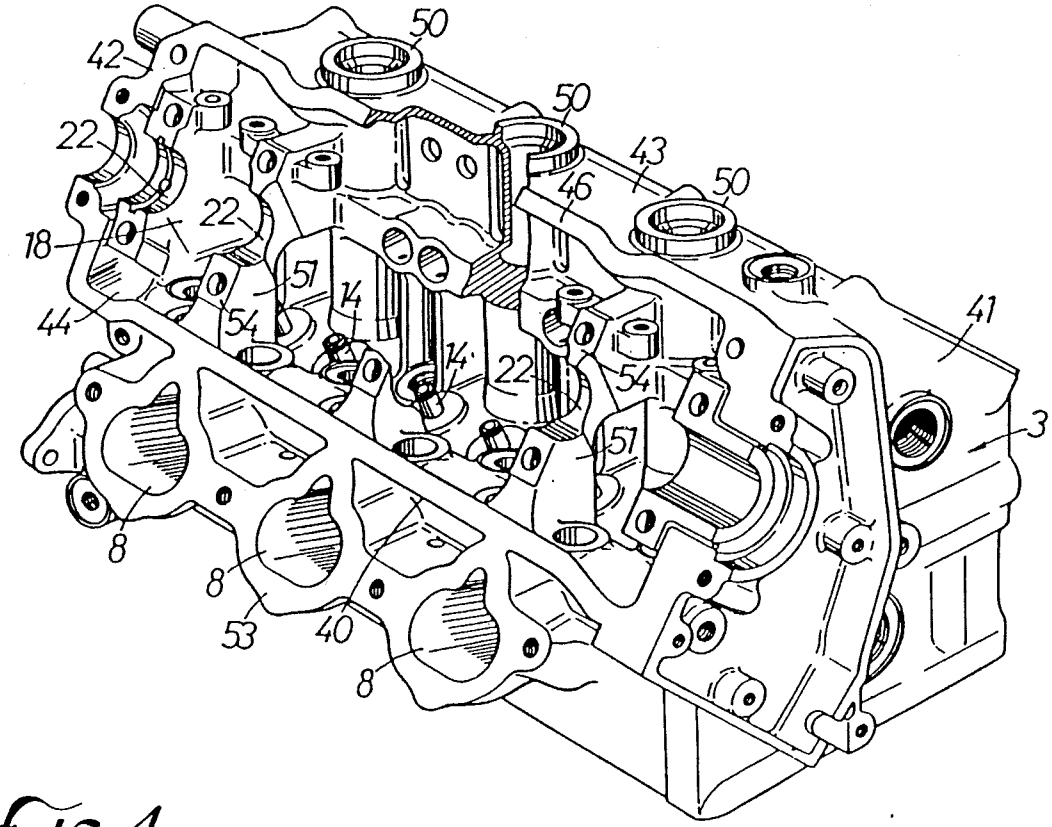
FIGS. 4 and 5 are perspective view of the top and side, respectively, of one of the cylinder heads.
Figure 5:
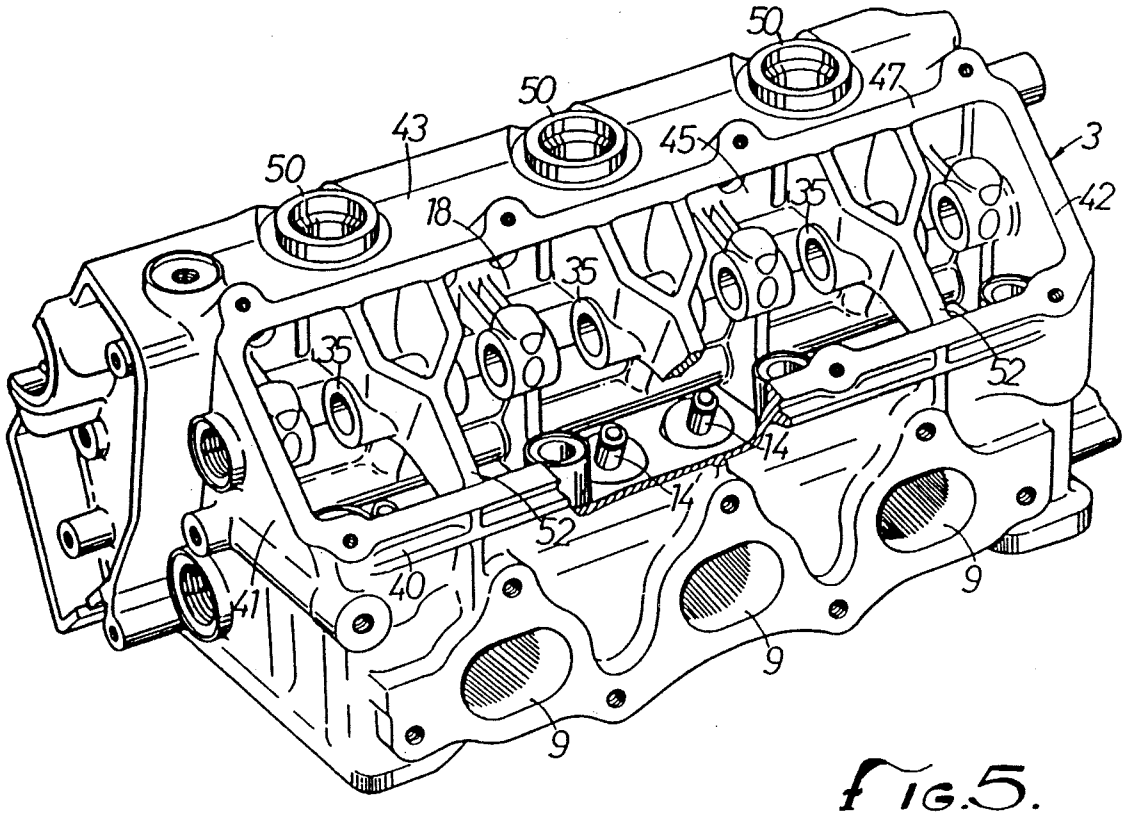

As illustrated in FIGS. 4 and 5, the valve mechanism chamber 18 is defined by a rectangular surrounding wall 40 extending upwardly from the peripheral edge of the bottom of the chamber 18, a pair of generally trapezoidal shaped end walls 41, 42 extending upwardly at the longitudinally opposite ends of the surrounding wall 40 beyond the upper edge thereof, and a ceiling wall 43 interconnecting the upper ends of the trapezoidal end walls 41, 42. The cylinder head 3 has two windows 44, 45 defined one on each side of the ceiling wall 43 and extending between the end walls 41, 42. The windows 44, 45 are open above the intake and exhaust valves 12, 13, respectively, to provide access to the valve operating mechanism A, which can therefore be inspected and serviced through the windows 44, 45. The cam shaft 21 is positioned in the window 44 which is closer to the valley V.

Cover attachment surfaces 46, 47 are formed around the windows 44, 45, respectively, are slanted progressively downwardly from the ceiling wall 43 toward the surrounding wall 40. Head covers 48, 49 (FIGS. 1 and 2) are attached by bolts to the cover attachment surfaces 46, 47.

As illustrated in FIGS. 2, 4 and 5, cylindrical plug housings 50 are integrally formed with the ceiling walls 6a of the combustion chambers 6 and project upwardly for accommodating the spark plugs 16 respectively therein. The plug housings 50 extend through the water jacket 17 and the valve mechanism chamber 18 and have open upper ends. The plug housings 50 are disposed between and integrally connected to the ceiling wall 43 of the valve mechanism chamber 18 and a ceiling wall 17a of the water jacket 17. High-voltage ignition cables (not shown) are connected to the respective spark plugs 16 through the plug housings 50. The spark plugs 16 can be attached and detached by a tool (not shown) insertable through the plug housings 50. Since the head cover 48, 49 are positioned on each side of the plug housings 50 without direct engagement therewith, the head covers 48, 49 can easily be attached to and detached from the cylinder head 3 independently of the plug housings 50. Therefore, the valve operating mechanism A can efficiently be inspected and serviced.

Bridges 51, 52 are integrally joined between the plug housings 50 and the opposite side wall members of the surrounding wall 40. The bearing bases 22 are integral with the bridges 51 and the bearing bosses 35 are integral with the bridge 52. By this integral construction, the plug housings 50, the bearing bases 22, and the bearing bosses 35 are very rigid.

The cylinder head 3 has an attachment surface 53 to which the intake manifold Mi is attached and joint surfaces 54 of the bearing bases 22 to which the bearing caps 24 are joined. The attachment surface 53 and the joint surfaces 54 lie in the same plane with the inner cover attachment surface 46 close to the valley V in a substantially horizontal common plane extending across the cylinder arrays C1, C2, as shown in FIG. 1. Therefore, these surfaces 53, 54, 46 of the cylinder arrays C1, C2 can be machined simultaneously with a common cutting tool, whereby the cylinder head 3 can be machined highly accurately and efficiently.

The outer cover attachment surface 47 remote from the valley V is defined in a substantially vertical plane to minimize the maximum outer dimensions of each of the cylinder arrays C1, C2. Since only the cover 49 is attached to the surface 47 and no other engine components are attached to the surface 47, the angle and spacing of surface 47 relative to the other surfaces on the cylinder head are not critical whereby the machine of surface 47 may be easily accomplished.

Although a certain preferred embodiment has been shown and described, it should be understood that many changes and modifications may be made therein without departing from the scope of this invention as defined by the appended claims.

What is claimed:

1. In an internal combustion engine, with a plurality of cylinders in a line, a cylinder head having a combustion chamber ceiling for each cylinder, said ceilings having a common centerline extending along the line of cylinders, intake valves and ports on one side of said centerline and exhaust valves and ports on the other side of said centerline, said cylinder head having a first window opposite said intake valves and a second window opposite said exhaust valves for access to said valves, a ceiling wall integrally formed in said cylinder head having an upper section extending between and in contact with said first and second windows, and spark plug housings extending from said section of said ceiling wall to substantially the centerline of each said combustion chamber ceiling for receiving a spark plug.

2. The engine of claim 1 wherein said first window has an attachment surface for receiving a cover which surface lies in a common plane with an attachment surface for an intake manifold of the engine.

3. An internal combustion engine comprising:

a cylinder block having a plurality of cylinders each having an axis;

a cylinder head having a plurality of combustion chambers having respective ceiling walls and opening into said cylinders, intake and exhaust ports communicating with each of said combustion chambers on opposite sides of said axis, intake and exhaust valves disposed on each side of said axis of each of the cylinders for opening and closing said intake and exhaust ports, respectively, a valve mechanism chamber defined above said combustion chambers, and a valve operating mechanism housed in said valve mechanism chamber for actuating said intake and exhaust valves, said valve mechanism chamber being defined by a pair of opposite trapezoidal end walls extending from the bottom of the valve mechanism chamber and a ceiling wall integrally formed in said cylinder head interconnecting the upper ends of said trapezoidal end walls, said valve mechanism chamber having a pair of windows defined one on each side of an upper section the ceiling wall thereof between said trapezoidal end walls to provide access therethrough to said valve operating mechanism, said cylinder head having cover attachment surfaces extending peripherally around said windows, respectively, and a plurality of cylindrical plug housings extending between said ceiling walls of the combustion chambers and said upper section of said ceiling wall of the valve mechanism chamber;

a plurality of spark plugs mounted on said ceiling walls, respectively, and accommodated in said plug housings, respectively, in substantial alignment with the axes of said cylinders; and a pair of head covers removably attached respectively to said cover attachment surfaces in closing relation to said windows.

4. An internal combustion engine according to claim 3, wherein said cylinder block comprises a pair of cylinder arrays each having said cylinders and interconnected in a V shape with a central space defined between said cylinder arrays, said cylinder head being mounted on each of said cylinder arrays, said valve operating mechanism in each of the cylinder heads having a cam shaft operatively associated with said intake and exhaust valves and positioned in one of said windows which is closer to said central space.

5. An internal combustion engine according to claim 4, wherein one of said cover attachment surfaces is more remote from said central space and extends in a substantially vertical plane.

6. An internal combustion engine according to claim 3, including an intake manifold attached to said cylinder head in communication with said intake ports, said cylinder head having an attachment surface which lies in a common plane with one of said cover attachment surfaces and to which said intake manifold is attached.

7. An internal combustion engine according to claim 6, said cylinder block comprises a pair of cylinder arrays interconnected in a V shape and each having said plurality of cylinders, a said cylinder head being mounted on each of said cylinder arrays, said intake manifold being positioned between said cylinder arrays and connected to the cylinder heads on the respective cylinder arrays, said attachment surface and said one of the cover attachment surfaces of the cylinder heads lying in a common plane.

8. An internal combustion engine according to claim 6, wherein said cylinder head includes a plurality of bearing bases integral therewith and a plurality of bearing caps joined respectively thereto through respective joint surfaces of the bearing bases, said valve operating mechanism having a cam shaft rotatably supported between said bearing bases and said bearing caps and operatively associated with said intake and exhaust valves, said joint surfaces lying in a common plane with said attachment surface and said one of the cover attachment surfaces.

* * * * *